US009657450B2

(12) United States Patent
Gandolfi

(10) Patent No.: US 9,657,450 B2
(45) Date of Patent: May 23, 2017

(54) SNOW CLEARING DEVICE

(71) Applicant: GILETTA S.p.A., Revello (CN) (IT)

(72) Inventor: Fabio Gandolfi, Lizzano in Belvedere (IT)

(73) Assignee: GILETTA S.p.A. (IT)

( * ) Notice: Subject to any disclaimer, the term of this patent is extended or adjusted under 35 U.S.C. 154(b) by 0 days.

(21) Appl. No.: 14/895,088

(22) PCT Filed: Jun. 16, 2014

(86) PCT No.: PCT/IB2014/062259
§ 371 (c)(1),
(2) Date: Dec. 1, 2015

(87) PCT Pub. No.: WO2014/203143
PCT Pub. Date: Dec. 24, 2014

(65) Prior Publication Data

US 2016/0102440 A1 Apr. 14, 2016

(30) Foreign Application Priority Data

Jun. 18, 2013 (IT) ..... BO2013A0304

(51) Int. Cl.
*E01H 5/06* (2006.01)

(52) U.S. Cl.
CPC ..... *E01H 5/062* (2013.01); *E01H 5/063* (2013.01); *E01H 5/066* (2013.01)

(58) Field of Classification Search
CPC ..... E01H 5/062; E01H 5/063; E01H 5/066; E01H 5/061; E01H 5/067
(Continued)

(56) References Cited

U.S. PATENT DOCUMENTS 3,807,064 A 4/1974 Schmidt
4,320,589 A 3/1982 Pelazza
(Continued)

FOREIGN PATENT DOCUMENTS

DE 9201494 4/1992
EP 1840272 10/2007

OTHER PUBLICATIONS

Corresponding International Search Report and Written Opinion for PCT/IB2014/062259 dated Nov. 5, 2014.

*Primary Examiner* — Matthew D Troutman
(74) *Attorney, Agent, or Firm* — The Belles Group, P.C.

(57) ABSTRACT

A snow-plough blade group for absorbing lateral impacts comprising: a first and a second snow-removing blade; a first support bearing the blades; the second blade being mobile with respect to the first support between a first position, in which the blades identify a first snow-removing surface, and a second position in which the blades identify a second snow-removing surface larger than the first one; a second support hinged to the first support; a first hydraulic cylinder connected between the first and second support for orientating the first support with respect to the second support; a discharge of liquid in overpressure; bypass valve means connecting the first hydraulic cylinder with the discharge, which bypass valve means are configured such that when the pressure in the first hydraulic cylinder exceeds a threshold value, the bypass valve means place the first hydraulic cylinder in liquid communication with the discharge; characterized in that a sensor detects a position assumed by the second blade; and the bypass valve means vary the threshold value according to the sensor reading.

5 Claims, 9 Drawing Sheets

(58) Field of Classification Search
USPC ..... 37/232, 234, 266, 274, 281
See application file for complete search history.

(56) References Cited

U.S. PATENT DOCUMENTS 5,285,588 A * 2/1994 Niemela ..... E01H 5/065
37/232
6,044,579 A * 4/2000 Hadler ..... E01H 5/06
172/811
6,154,986 A * 12/2000 Hadler ..... E01H 5/06
172/810
6,253,470 B1 * 7/2001 Depies ..... E01H 5/06
37/234

* cited by examiner

SNOW CLEARING DEVICE

CROSS-REFERENCE TO RELATED PATENT APPLICATIONS

The present application is a U.S. national stage application under 35 U.S.C. §371 of PCT Application No. PCT/IB2014/062259, filed Jun. 16, 2014, which claims priority to Italian patent application BO2013A000304, filed Jun. 18, 2013, the entireties of which are incorporated herein by reference.

FIELD OF THE INVENTION

The present invention relates to the technical sector relating to the removal of snow from roads, railways, etc: in detail, the invention relates to a snow-plough blade group for absorbing lateral impacts, which snow-plough blade group has a variable snow-removing surface.

DESCRIPTION OF THE PRIOR ART

Documents DE 92 01 494 and U.S. Pat. No. 3,807,064 each disclose a snow-plough blade group of known type.

FIGS. 1-4 schematically illustrate a snow-plough blade group (1) of known type in various operating positions, which will be discussed in the following; FIG. 5 illustrates a portion of hydraulic diagram (2) of the snow-plough blade group (1).

The above-mentioned snow-plough blade group (1) comprises: a first snow-removing blade (3); a second snow-removing blade (4) and a first support (5) bearing the first snow-removing blade (3) and the second snow-removing blade (4). The first snow-plough blade (3) is fixed with respect to the first support (5), while the second snow-plough blade (4) can slide with respect to the first support (5) between a first position (H1), in which the first snow-plough blade (3) and the second snowplough blade (4) identify a first snow-removing surface (FIG. 1), and a second position (H2) in which the first snow-plough blade (3) and the second snow-plough blade (4) identify a second snow-removing surface (7) (FIG. 2) which is larger than the first snow-removing surface (6). Further, the first snow-plough blade group (1) comprises: a second support (8) which is hinged to the first support (5) by means of a connecting member (9); a first hydraulic cylinder (10) and a second hydraulic cylinder (11) which are both connected between the first support (5) and the second support (8) such as to orientate the first support (5) with respect to the second support (8); and bypass valve means (12) (FIG. 5) which connect the first hydraulic cylinder (10) with the second hydraulic cylinder (11), which bypass valve means (12) are configured such that when the pressure of the liquid contained in one of the hydraulic cylinders exceeds a threshold pressure value, the bypass valve means (12) place the two hydraulic cylinders in liquid communication so as to limit the liquid overpressure which is generated internally of one thereof.

The second support (8) is borne by a work vehicle that is not illustrated: for example the second support (8) is fixed to the frame of a work vehicle.

FIG. 1 illustrates the snow-plough blade group (1) when the second snow-plough blade (4) is in the first position (H1) and is subject to a first lateral impact (represented by force (F1)), due for example to the presence of a lateral obstacle (not illustrated). A "lateral impact" is an impact (for example against a pavement or a kerb) which takes place at the projecting end (27) towards the outside part of the second snow-plough blade (4); this type of impact is very frequent as the operator driving the work vehicle bearing the snow-plough blade (1) has greater difficulty in identifying (and therefore avoiding) obstacles which are located at the edges of his or her field of view.

The first lateral impact can determine a stress on the piston (13) of the first hydraulic cylinder (10) such as to lead to a brusque raising of the pressure of the liquid contained in the chamber (14) of the first hydraulic cylinder (10); if the overpressure that has reached the chamber (14) of the first hydraulic cylinder (10) exceeds the threshold pressure value, the bypass valve means (12) (which in the example comprise two single-acting bypass valves arranged in parallel) place the chamber (14) of the first hydraulic cylinder (10) with the chamber (15) of the second hydraulic cylinder (11) in liquid communication, enabling the liquid contained in the chamber (14) of the first hydraulic cylinder (10) to flow towards the chamber (15) of the second hydraulic cylinder (11), thus limiting the overpressure of liquid which has been generated in the chamber (14) of the first hydraulic cylinder (10). Consequently the first support (5), and therefore the first snow-plough blade (3) and the second snow-plough blade (4), modifies the orientation thereof (see FIG. 3), which enables the snow-plough blade group (1) to absorb the first lateral impact optimally and to overcome the obstacle.

In the example illustrated in FIG. 1 the stress on the piston (13) of the first hydraulic cylinder (10) depends on the force (F1) which originates from the first lateral impact of the obstacle with the second snow-plough blade (4), and from the lever arm (B1) existing between the application point of the force (F1) and the hinge point (28) of the first support (5).

The threshold pressure value is selected so as to safeguard the snow-plough blade group (1): in fact, the bypass valve means (12) must intervene only when the impact of the second snow-plough bade (4) against an obstacle can compromise the functioning and the integrity of the components of the same snow-plough blade group (1).

FIG. 2 illustrates the snow-plough blade group (1) when the second snow-plough blade (4) is in the second position (H2) and is subjected to a second lateral impact (represented by force F2): the lever arm (B2) existing between the point of application of the force and the hinge point (28) of the first support (5) is in this case greater and therefore, given an equal force generated by the lateral impact, can lead to a much higher stress on the piston (13) of the first hydraulic cylinder (10).

This represents a drawback: if the selected threshold value is optimal for the functioning of the snow-plough blade group (1) when the second snow-plough blade (4) is in the first position (H1), when the second snow-plough blade (4) is in the second position (H2) the bypass valve means (12) might also intervene only due to the presence of accumulated snow against the second snow-plough blade (4); if the selected threshold pressure value is on the other hand optimal for the functioning of the snow-plough blade group (1) when the second snow-plough blade (4) is in the second position (H2), when the second snow-plough blade (4) is in the first position (H1) and impacts against an obstacle the bypass valve means (12) might not intervene and this non-intervention might cause damage to one or more components of the snow-plough blade group (1).

SUMMARY OF THE INVENTION

The aim of the present invention is to obviate the above-described drawback.

The above aim is obtained by means of a snow-plough blade group (1) according to claim 1.

The invention enables defining a threshold pressure value according to the position assumed by the second snow-plough blade (4): in this way, it is always advantageously possible to associate to a specific position assumed by the second snow-plough blade (4) an optimal threshold pressure value assumed by the bypass valve means (12).

BRIEF DESCRIPTION OF THE DRAWINGS

Specific embodiments of the invention will be described in the following of the present description, according to what is reported in the claims and with the aid of the accompanying tables of drawings, in which:

DESCRIPTION OF PREFERRED EMBODIMENTS

Figure 1:
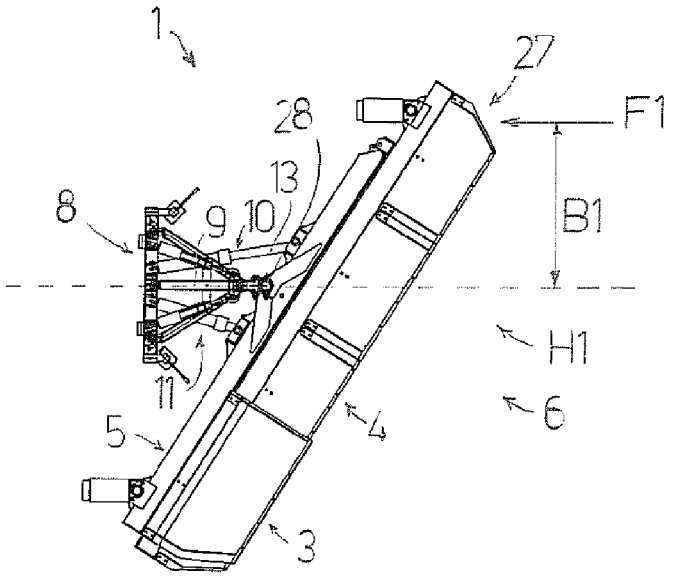
FIGS. 1-4 schematically illustrate a snow-plough blade group of known type in various working positions.
Figure 3:
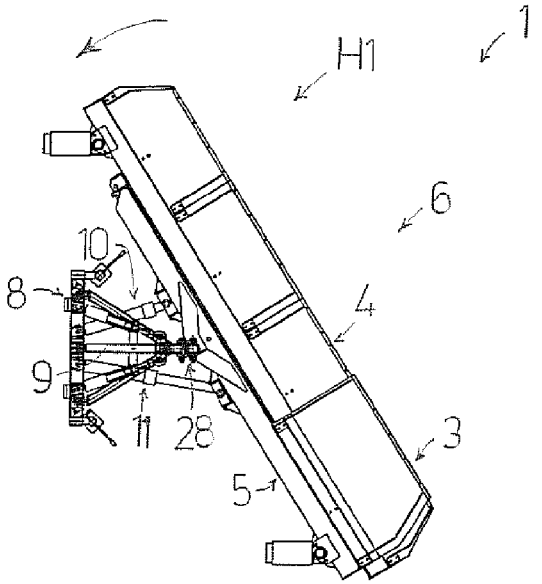
Figure 2:
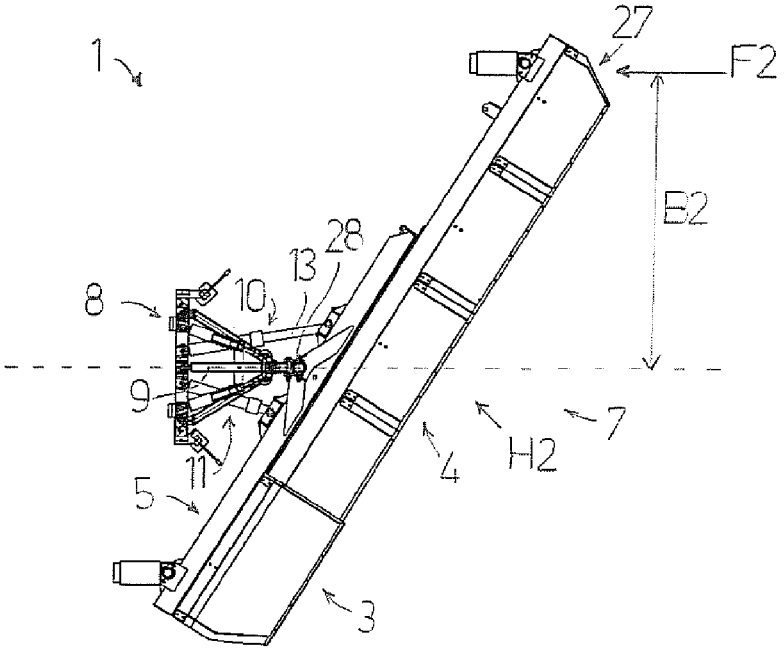
Figure 4:
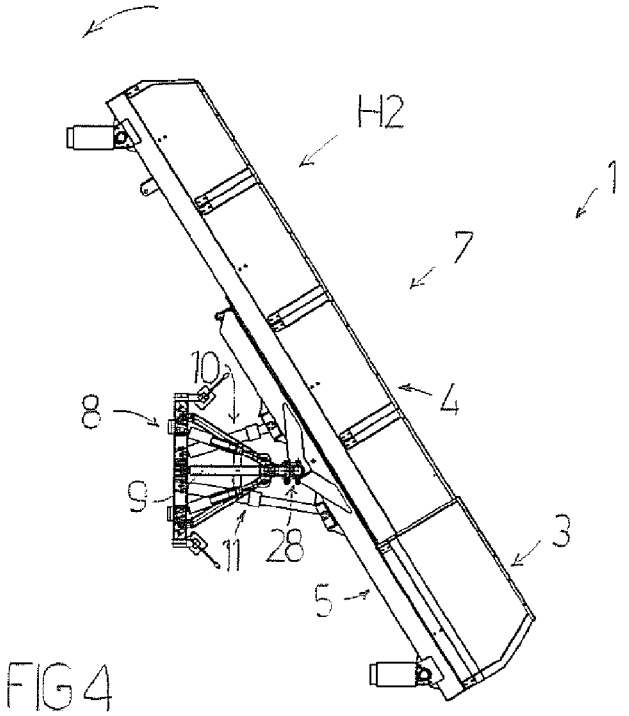
Figure 5:
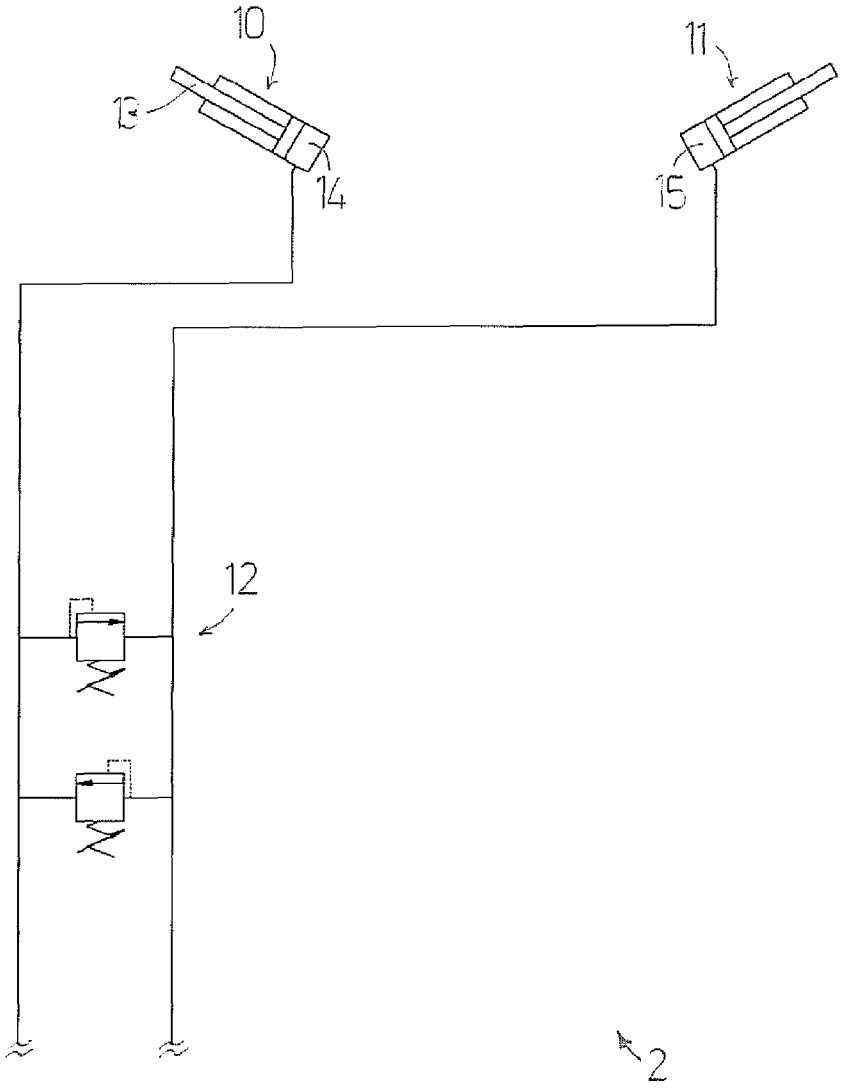
FIG. 5 illustrates a portion of a hydraulic diagram of the snow-plough blade group of FIG. 1-4.
Figure 6:
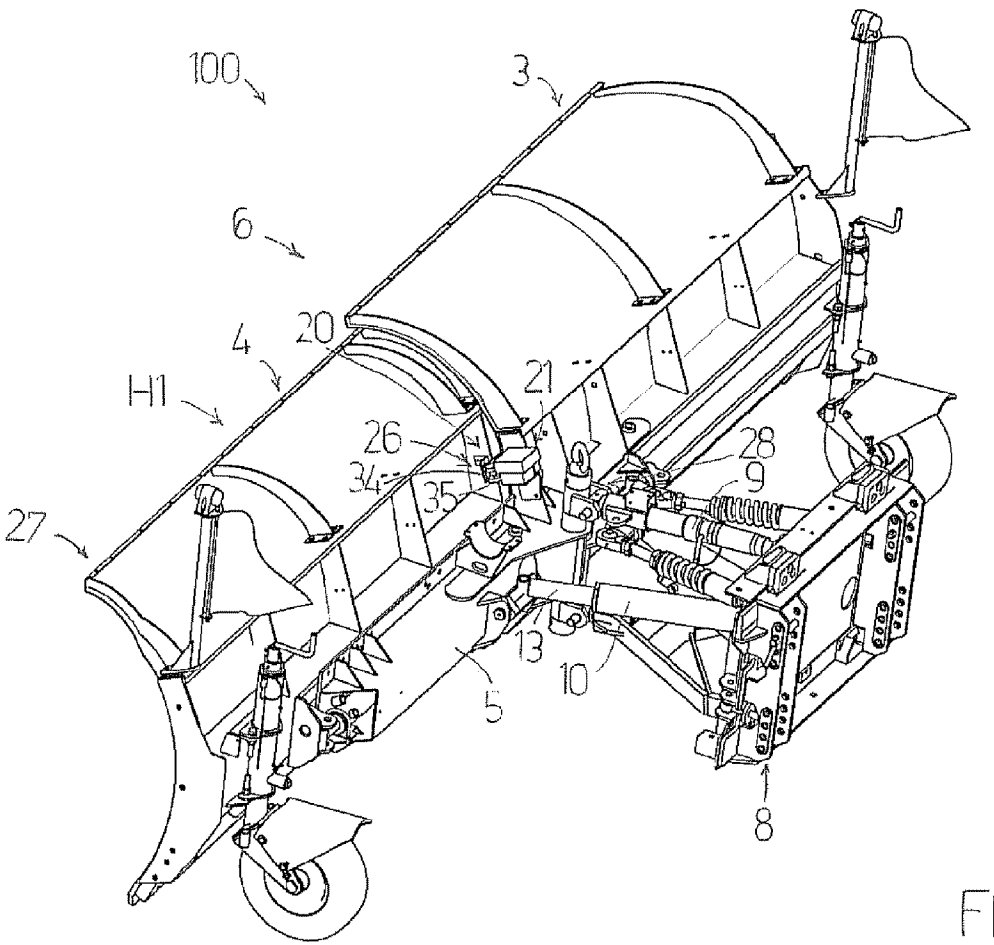
FIG. 6 is a perspective view of the snow-plough blade group object of the present invention, in a first working position.
Figure 7:
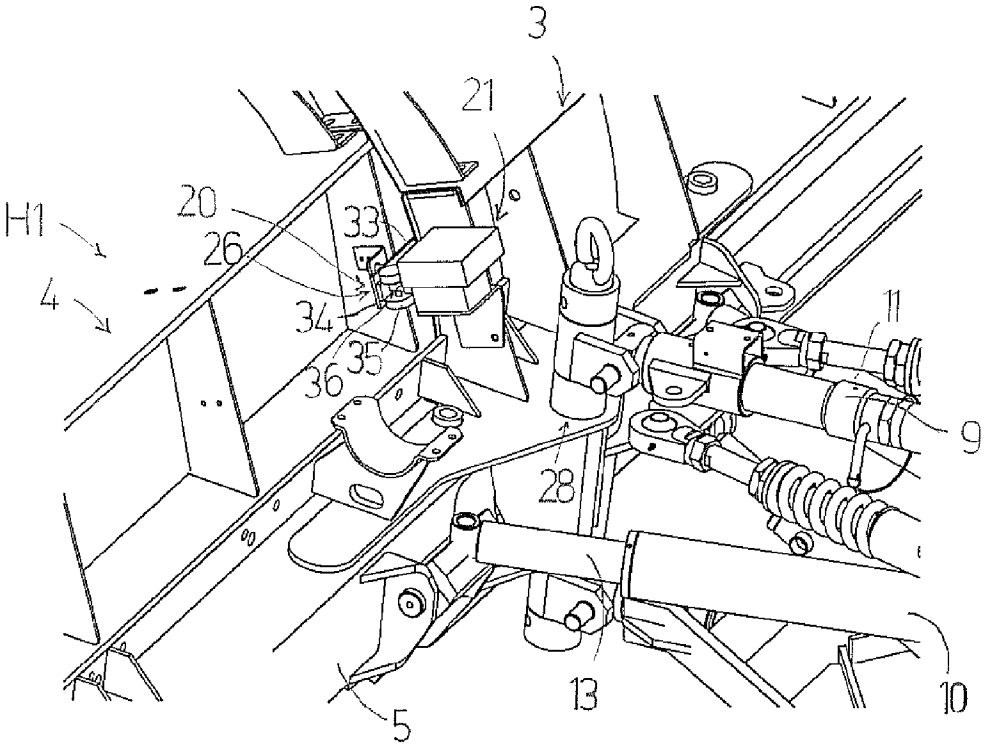
FIG. 7 is a view of a detail in larger scale of the snow-plough blade group of FIG. 6 when the snow-plough blade group is in the first working configuration.
Figure 8:
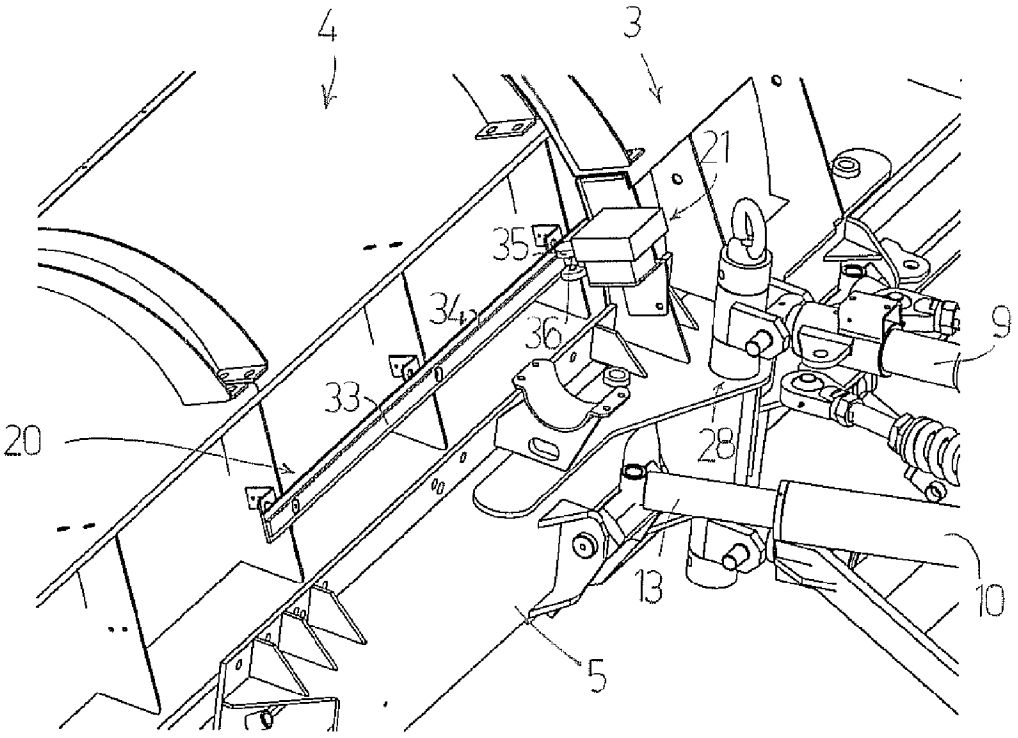
FIG. 8 is a view of the larger-scale detail of the snow-plough blade group of FIG. 6, when the snow-plough blade group is in a second working configuration.
Figure 9:
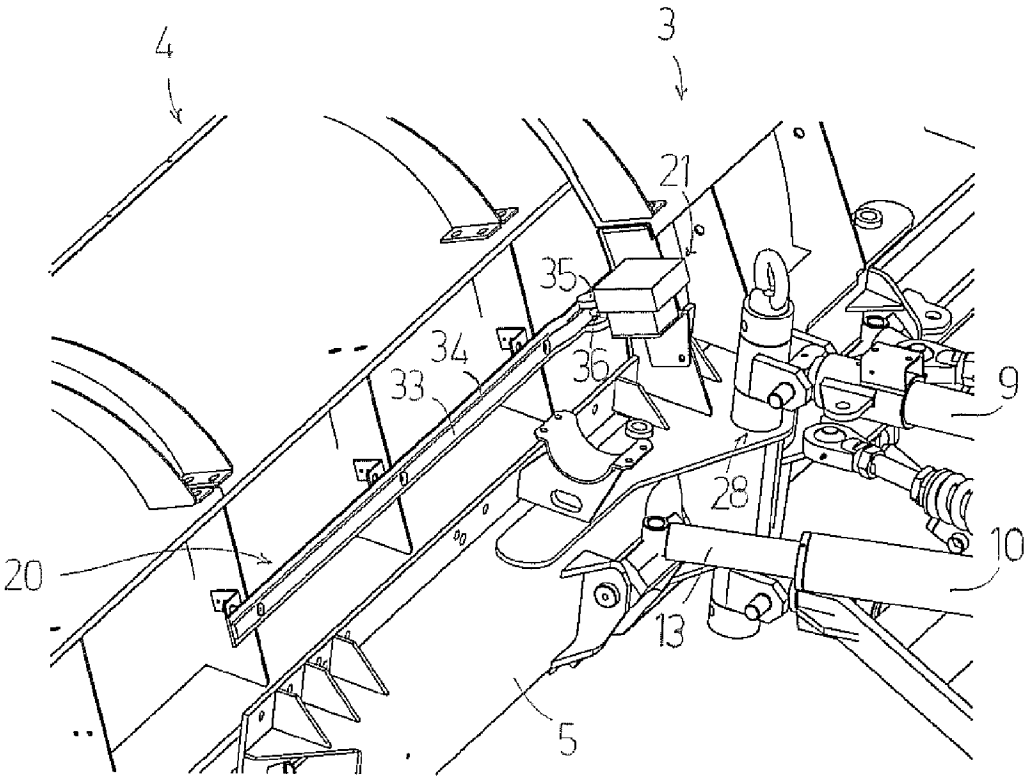
FIG. 9 is a view of the larger-scale detail of the snow-plough blade group of FIG. 6 when the snow-plough blade group is in a third working configuration.
Figure 10:
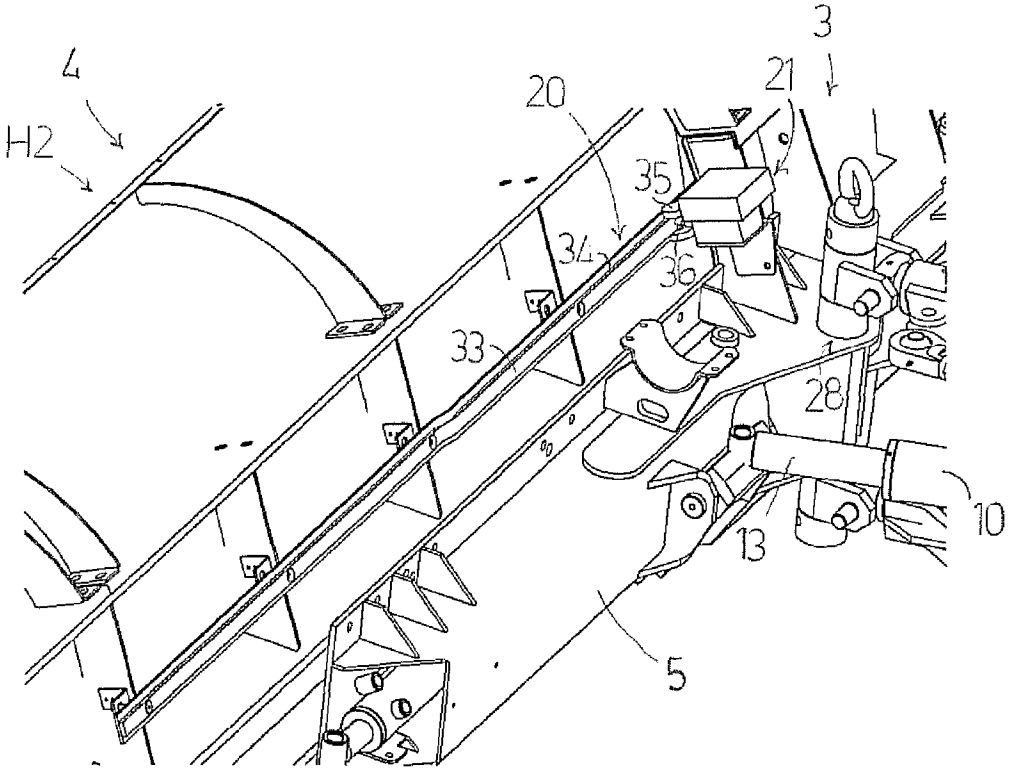
FIG. 10 is a view of the larger-scale detail of the snow-plough blade group of FIG. 6 when the snow-plough blade group is in a fourth working configuration.

With reference to FIGS. 6-11, reference numeral (100) relates to a snow-plough blade group for absorbing lateral impacts, object of the present invention.

The snow-plough blade group (100) has a variable snow-removing surface for absorbing lateral impacts and comprises: a first snow-removing blade (3); a second snow-removing blade (4); a first support (5) bearing the first snow-removing blade (3) and the second snow-removing blade (4). The second snow-removing blade (4) is mobile with respect to the first support (5) between a first position (H1) (illustrated in FIGS. 6, 7), in which the first snow-removing blade (3) and the second snow-removing blade (4) identify a first snow-removing surface (6), and a second position (H2) (FIG. 10) in which the first snow-removing blade (3) and the second snow-removing blade (4) identify a second snow-removing surface (7) which is larger than the first snow-removing surface (6). The snow-plough blade group (100) further comprises: a second support (8) (FIG. 6) which is hinged to the first support (5); a first hydraulic cylinder (10) which is connected between the first support (5) and the second support (8) for orientating the first support (5) with respect to the second support (8); a discharge (15) of liquid in overpressure; bypass valve means (12) which connect the first hydraulic cylinder (10) with the discharge (15) of liquid in overpressure, which bypass valve means (12) are configured such that when the pressure of the liquid contained in the first hydraulic cylinder (10) exceeds a threshold pressure value, due to a lateral impact on the second snow-removing blade (4), the bypass valve means (12) place the first hydraulic cylinder (10) in liquid communication with the discharge (15) of liquid in overpressure, thus modifying the orientation of the first support (5), of the first snow-removing blade (3) and of the second snow-removing blade (4) with respect to the second support (8); a sensor (17) which detects a position assumed by the second snow-removing blade (4) with respect to the first support (5). The bypass valve means (12) vary the threshold pressure value according to the sensor (17) reading.

A "lateral impact" is an impact (for example against a pavement or a kerb) which occurs at the externally-projecting end (27) of the second snow-plough blade (4); this type of impact is very frequent as the operator driving the work vehicle, which for example bears the snow-plough blade group (100), has greater difficulty in identifying (and therefore avoiding) obstacles which are located at the marginal edges of his or her visual field.

The second support (8) can be borne by a work vehicle that is not illustrated: for example the second support (8) is fixed to the frame of the work vehicle.

The snow-plough blade group (100) preferably comprises a second hydraulic cylinder (11) which is connected between the first support (5) and the second support (8) such as to orientate the first support (5) with respect to the second support (8); wherein the discharge (15) of liquid in overpressure is defined by the chamber (15) of the second hydraulic cylinder (11).

The bypass valve means (12) preferably comprise: a switch (21) having at least three ways comprising a first way (22), a second way (23), a third way (24) and a lever (25) which is mobile between a first position (FIG. 11), in which the lever (25) places the first way (22) of the switch (21) in liquid communication with the third way (24) of the switch (21), and a second position (not illustrated), in which the lever (25) places the second way (23) of the switch (21) in liquid communication with the third way (24) of the switch (21); a first single-directional bypass valve (18) having a first threshold pressure value, which first single-directional bypass valve (18) has at least a first way (29) and a second way (30) and is connected to the first way (22) of the switch (21); and a second single-directional bypass valve (19) having a second threshold pressure value which is greater than the first threshold pressure value, which second single-directional bypass valve (19) has at least a first way (31) and a second way (32) and is connected to the second way (23) of the switch (21). The sensor (17) comprises: a body (20) having a shaped profile (33), which body (20) is fixed to the second snow-removing blade (4); and a cursor (26) which couples with the shaped profile (33) of the body (20) in order to activate the lever (25) of the switch (21). The snow-plough blade group (100) is configured such that: when the second snow-removing blade (4) is in the first position (H1) the lever (25) of the switch (21) is in the first position, connecting the first hydraulic cylinder (10) with the discharge (15) of liquid in overpressure via the first single-directional bypass valve (18); when the second snow-removing blade (4) is in the second position (H2) the lever (25) of the switch (21) is in the second position, connecting the first hydraulic cylinder (10) with the discharge (15) of liquid in overpressure via the second single-directional bypass valve (19).

Figure 11:
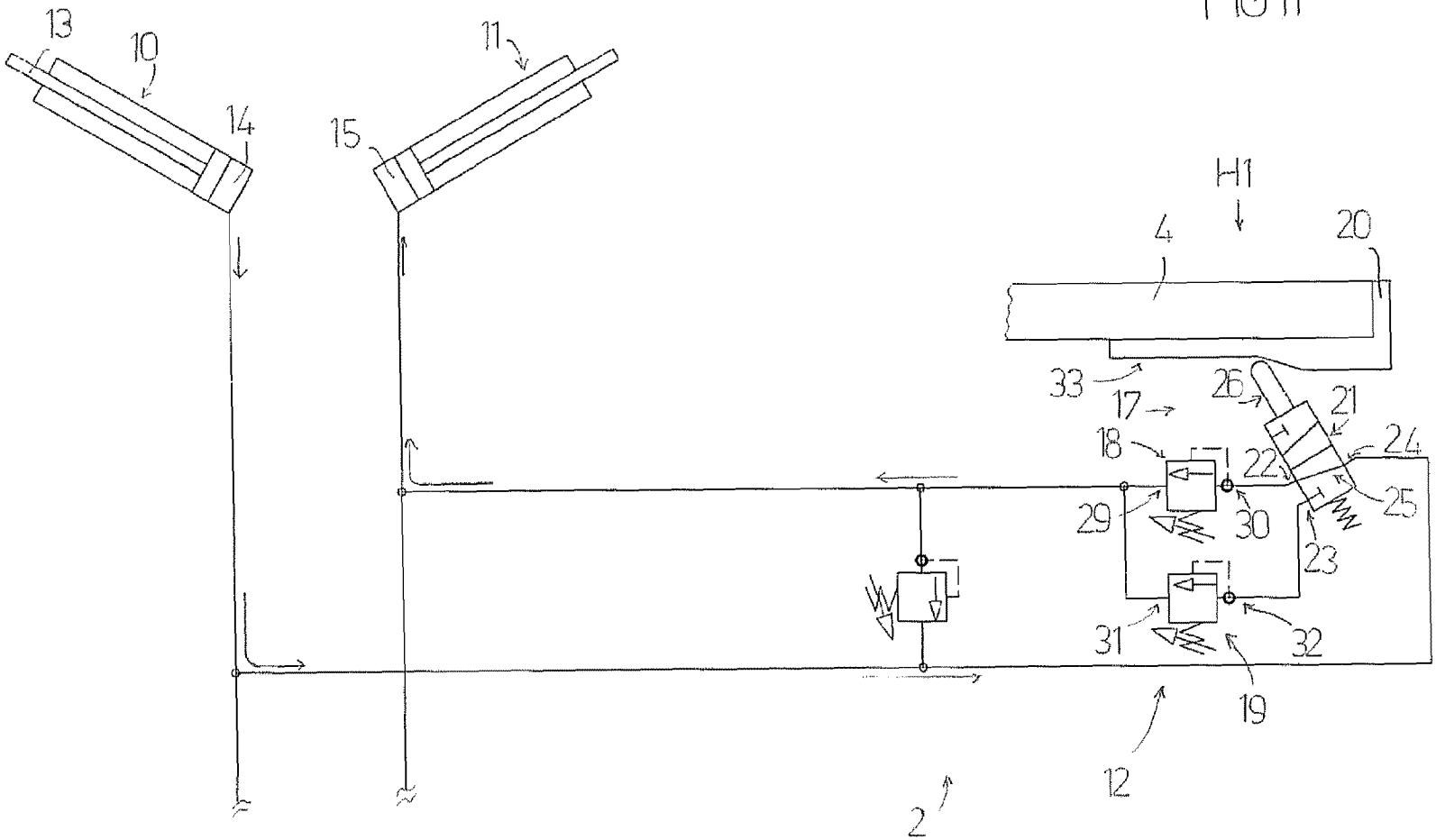
FIG. 11 illustrates an embodiment of a portion of hydraulic diagram of the snow-plough blade group of FIG. 6.

In greater detail, and according to an embodiment illustrated in FIG. 11: the first way (29) of the first single-directional bypass valve (18) is connected to the discharge (15) of liquid in overpressure; the second way (30) of the first single-directional bypass valve (18) is connected to the first way (22) of the switch (21); the first way (31) of the second single-directional bypass valve (19) is connected to the discharge (15) of liquid in overpressure; the second way (32) of the second single-directional bypass valve (19) is connected to the second way (23) of the switch (21); the third way (24) of the switch (21) is connected to the first hydraulic cylinder (10).

The shaped profile (33) is preferably a rail (34) and the cursor (26) comprises an idle roller (35) which runs along the rail (34) and a command rod (36) which rotatably bears the idle roller (35) and which activates the lever (25) of the switch (21).

In the illustrated figures the second snow-plough blade (4) can slide with respect to the first snow-plough blade (3); alternatively, the second snow-plough blade (4) can for example rotate with respect to the first snow-plough blade (3) about a hinge axis (this solution is not illustrated).

The foregoing has been described by way of non-limiting example and any eventual constructional variants are considered to fall within the protective scope of the present technical solution, as claimed in the following.

The invention claimed is:

1. A snow-plough blade group for absorbing lateral impacts, the snow-plough blade group having a variable snow removing surface for absorbing lateral impacts and comprising:

a first snow-removing blade;

a second snow-removing blade;

a first support bearing the first snow-removing blade and the second snow-removing blade;

the second snow-removing blade being mobile with respect to the first support between a first position, in which the first snow-removing blade and the second snow-removing blade identify a first snow-removing surface, and a second position in which the first snow-removing blade and the second snow-removing blade identify a second snow-removing surface which is larger than the first snow-removing surface;

a second support which is hinged to the first support;

a first hydraulic cylinder which is connected between the first support and the second support for orientating the first support with respect to the second support;

a discharge of liquid in overpressure;

a bypass valve means which connect the first hydraulic cylinder with the discharge of liquid in overpressure, which the bypass valve means are configured such that when the pressure of the liquid contained in the first hydraulic cylinder exceeds a threshold pressure value, due to a lateral impact on the second snow-removing blade the bypass valve means places the first hydraulic cylinder in liquid communication with the discharge of liquid in overpressure, thus modifying the orientation of the first support, of the first snow-removing blade and of the second snow-removing blade with respect to the second support;

further comprising a sensor which detects a position assumed by the second snow-removing blade with respect to the first support; and wherein the bypass valve means vary the threshold pressure value according to the sensor reading.

2. The snow-plough blade group of claim 1, wherein:

the bypass valve means comprises:

a switch having at least three ways comprising a first way, a second way, a third way and a lever which is mobile between a first position, in which the lever places the first way of the switch in liquid communication with the third way of the switch, and a second position, in which the lever places the second way of the switch in liquid communication with the third way of the switch;

a first single-directional bypass valve having a first threshold pressure value, which first single-directional bypass valve has at least a first way and a second way and is connected to the first way of the switch; and a second single-directional bypass valve having a second threshold pressure value which is greater than the first threshold pressure value, which second single-directional bypass valve has at least a first way and a second way and is connected to the second way of the switch;

the sensor comprises:

a body having a shaped profile, which body is fixed to the second snow-removing blade; and a cursor which couples with the shaped profile of the body in order to activate the lever of the switch;

the snow-plough blade group being configured such that when the second snow-removing blade is in the first position the lever of the switch is in the first position, connecting the first hydraulic cylinder with the discharge of liquid in overpressure via the first single-directional bypass valve; and when the second snow-removing blade is in the second position the lever of the switch is in the second position, connecting the first hydraulic cylinder with the discharge of liquid in overpressure via the second single-directional bypass valve.

3. The snow-plough blade group of claim 2, wherein: the first way of the first single-directional bypass valve is connected to the discharge of liquid in overpressure; the second way of the first single-directional bypass valve is connected to the first way of the switch; the first way of the second single-directional bypass valve is connected to the discharge of liquid in overpressure; the second way of the second single-directional bypass valve is connected to the second way of the switch; the third way of the switch is connected to the first hydraulic cylinder.

4. The snow-plough blade group of claim 2, wherein the shaped profile is a rail and wherein the cursor comprises an idle roller which runs along the rail which rotatably bears the idle roller and which activates the lever of the switch.

5. The snow-plough blade group of any one of the preceding claim 1, comprising a second hydraulic cylinder which is connected between the first support and the second support such as to orientate the first support with respect to the second support; wherein the discharge of liquid in overpressure is defined by the chamber of the second hydraulic cylinder.

* * * * *